US006475343B1

(12) United States Patent
Grabscheid et al.

(10) Patent No.: US 6,475,343 B1
(45) Date of Patent: Nov. 5, 2002

(54) PROCESS AND DEVICE FOR DEWATERING A FIBROUS MATERIAL WEB

(75) Inventors: Joachim Grabscheid, Gerstetten (DE); Karl Josef Böck, Heidenheim (DE); Ulrich Begemann, Heidenheim (DE); Thomas Elenz, Steinheim (DE); Peter Mirsberger, Baienfurt (DE); Hans Dahl, Ravensburg (DE); Hannes Vomhoff, Djursholm (SE); David Beck, Appleton, WI (US)

(73) Assignee: Voith Sulzer Papiertechnik Patent GmbH, Heindenheim (DE)

( * ) Notice: Subject to any disclaimer, the term of this patent is extended or adjusted under 35 U.S.C. 154(b) by 0 days.

(21) Appl. No.: 09/696,181

(22) Filed: Oct. 26, 2000

(30) Foreign Application Priority Data

Oct. 27, 1999 (DE) ..... 199 51 794

(51) Int. Cl.[7] ..... D21F 1/52; D21F 1/66; D21F 1/88

(52) U.S. Cl. ..... 162/207; 162/208; 162/289; 162/297

(58) Field of Search ..... 162/205, 206, 162/207, 289, 290, 291, 292, 293, 294, 295, 296, 297; 34/523–594

(56) References Cited

U.S. PATENT DOCUMENTS

| | | | | |
|---|---|---|---|---|
| 3,284,285 A | | 11/1966 | Holden | |
| 3,657,069 A | * | 4/1972 | Candor et al. | 162/205 |
| 4,157,938 A | * | 6/1979 | Clemens et al. | 162/207 |
| 4,915,788 A | * | 4/1990 | Winheim | 162/207 |
| 5,355,595 A | * | 10/1994 | Koivukunnas et al. | 34/570 |
| 5,445,746 A | * | 8/1995 | Lee | 210/783 |
| 5,482,594 A | * | 1/1996 | Salminen | 162/60 |
| 5,865,955 A | * | 2/1999 | Ilvespaa et al. | 162/207 |
| 6,080,279 A | * | 6/2000 | Hada et al. | 162/290 |
| 6,083,346 A | * | 7/2000 | Hermans et al. | 162/115 |
| 6,085,437 A | * | 7/2000 | Stipp | 34/115 |
| 6,096,169 A | * | 8/2000 | Hermans et al. | 162/115 |
| 6,197,154 B1 | * | 3/2001 | Chen et al. | 162/109 |
| 6,280,573 B1 | * | 8/2001 | Lindsay et al. | 162/198 |
| 6,306,257 B1 | * | 10/2001 | Hada et al. | 162/290 |

FOREIGN PATENT DOCUMENTS

| | | |
|---|---|---|
| DE | 1461103 | 12/1968 |
| DE | 4342608 | 3/1995 |

OTHER PUBLICATIONS

J.D. Lindsay, "Displacement Dewatering toMaintain Bulk," paperi ja Puu vol. 74, No. 3/1992.

W. Kawka et al., "Some Results in Investigations on the Equipment for Intensive Dewatering and Drying of Porous Papers," EUCEPA–79 International Conference, Paper 31, pp. 153–169.

K. Räisänen, "High–Vacuum Dewatering on a Paper Machine Wire Section: A Literature Review," Paperi ja Puu, vol. 78, No. 3, 1996.

* cited by examiner

*Primary Examiner*—Peter Chin
*Assistant Examiner*—Carlos N. Lopez
(74) *Attorney, Agent, or Firm*—Greenblum & Bernstein, P.L.C.

(57) ABSTRACT

Process and apparatus for dewatering a fibrous material web. The process includes guiding the fibrous material web through a dewatering zone, and directing a plurality of gas pressure pulses of a pressurized displacement gas one after the other onto a surface of the fibrous material web within the dewatering zone. The apparatus includes a device for forming a plurality of gas pressure pulses which are arranged one after the other within the dewatering zone. The plurality of gas pressure pulses are directed onto a surface of the fibrous material web.

38 Claims, 1 Drawing Sheet

E
10
12
24
26
$P_1$
$P_2$
$P_3$
$P_4$
$14_1$
$14_2$
$14_3$
$14_4$
16
18
20
22

E
10
12
24
$P_1$
$P_2$
$P_3$
$P_4$
$14_1$
$14_2$
$14_3$
$14_4$
16
18
20
22

PROCESS AND DEVICE FOR DEWATERING A FIBROUS MATERIAL WEB

CROSS-REFERENCE TO RELATED APPLICATIONS

The present application claims priority under 35 U.S.C. § 119 of German Patent Application No. 199 51 794.0, filed on Oct. 27, 1999, the disclosure of which is expressly incorporated by reference herein in its entirety.

BACKGROUND OF THE INVENTION

1. Field of the Invention

The present invention relates to a process for dewatering a fibrous material web, e.g., a paper or cardboard web, in which the fibrous material web is guided through a dewatering zone in which it is at least partially dewatered by being impacted with pressurized displacement gas. Moreover, the present invention relates to a device for dewatering the fibrous material web a dewatering zone in which the fibrous material web is at least partially dewatered by being impacted by pressurized displacement gas.

2. Discussion of Background Information

Water can be removed from a paper web using a differential gas pressure. This process is referred to as displacement dewatering. In this process, the water located in the pores between the fibers is blown out of the bonded-web fabric. In comparison to conventional wet presses in a single- or double-felt roll nip, the finished paper has a higher specific volume at the same dry content as after mechanical dewatering. With the aid of the displacement dewatering process, other important characteristics of the finished fibrous material web, such as bending stiffness, porosity, and opacity, can be positively influenced (J. D. Lindsay: "Displacement Dewatering to Maintain Bulk," Paperi ja Puu Vol. 74/No. 3/1992). A corresponding device arrangement for the displacement dewatering process has also already been suggested (W. Kawka and E. Szwarcztajn: "Some Results of Investigations on the Equipment for Intensive Dewatering and Drying of Porous Papers," EUCEPA-79 International Conference, Paper 31, Page 153).

If a membrane is placed over the paper on the side of the gas pressure, a compression of the paper will occur as a result of the decrease in pressure in the membrane. Water is pressed out of the fibers into the pores between the fibers. This water is blown out of the pores by the differential gas pressure. According to the invention, when a membrane is used, a higher dry content is achieved (Kari Räisanen: "High-Vacuum Dewatering on a Paper Machine Wire Section: A Literature Review," Paperi ja Puu, Vol. 78, No. 3, 1996).

The size of this compression depends on the relationship between the permeability of the membrane and of the bonded-web fabric. With a targeted compression, dry content and specific volume of the finished fibrous material web can be adjusted. In practice, however, the compression of the bonded-web fabric can be controlled only with difficulty because membrane permeability is difficult to change during operation of the production facility. Thus, in the case of otherwise identical process conditions, a certain dry content and a certain volume result at a certain gas pressure.

SUMMARY OF THE INVENTION

The present invention is directed to a process and a device of the type generally discussed above in which the process parameters of the displacement dewatering process can be deliberately adjusted and, correspondingly, the results of the displacement dewatering process, with regard to the dry content achieved and to the paper-related characteristics of the finished product, e.g., specific volume, porosity, surface roughness, and/or the like, can be intentionally influenced.

With regard to the process, the present invention includes impacting the fibrous material web with several gas pressure pulses one after another inside the dewatering zone.

Due to this construction, the bonded-web fabric, which has viscoelastic characteristics, is only compressed to a limited extent. If it is taken into account that the compression of the bonded-web fabric is accompanied by a reduction in flow resistance, it is possible, by making the impact with pressure correspondingly shorter, to prevent the bonded-web fabric from becoming too strongly compressed, which could result in the necessary amount of gas being unable to be pressed through the bonded web fabric.

In a suitable practical embodiment, the fibrous material web is guided through several displacement dewatering units within the dewatering zone.

The level of the pressure of at least one gas pressure pulse is advantageously adjustable, and, more suitably, the pressures of the various gas pressure pulses are adjustable separately from one another. If the fibrous material web is guided through several displacement dewatering units arranged at a distance from one another within the dewatering zone, the prevailing pressures in the various displacement dewatering units are advantageously correspondingly adjustable.

In this way, the amount of compression can be adjusted at least partially by, e.g, the level of the prevailing pressure in the respective displacement dewatering units.

Thus, by an individual control of the gas pressure pulses, the dewatering process can be controlled and characteristics such as dry content, density, porosity, and/or the like can be influenced.

In a suitable practical embodiment, the fibrous material web is guided through the dewatering zone along with the membrane, and the fibrous material web is impacted by the displacement gas through the membrane. In principle, however, the displacement gas dewatering according to the present invention can also occur without such a membrane.

Preferably, the fibrous material web, which is being impacted by displacement gas from one side, is guided through the dewatering zone along with at least one wire or felt belt arranged on the other side of the web.

In principle, it is also possible to guide the fibrous material web through at least one displacement dewatering unit within the dewatering zone whose gas pressure is pulsing, i.e., changes over time, and, preferably, at a certain frequency.

In the device according to the invention, the fibrous material web can be impacted by several gas pressure pulses one after the other within the dewatering zone.

The dewatering devices of the various dewatering units can be different and, e.g., run from top to bottom in an alternating fashion.

On the side of the fibrous material web facing away from the gas pressure, a fabric can be arranged that forms a blocking layer. This blocking layer allows the dewatered fluid through. in only one direction, i.e., from the fibrous material web to the felt (anti-rewetting fabric). The blocking layer can be integrated into the felt.

The present invention is directed to a process for dewatering a fibrous material web. The process includes guiding the fibrous material web through a dewatering zone, and directing a plurality of gas pressure pulses of a pressurized displacement gas one after the other onto a surface of the fibrous material web within the dewatering zone.

In accordance with a feature of the instant invention, the fibrous material web can include one of a paper and a cardboard web.

Further, a plurality of displacement dewatering units may be arranged within the dewatering zone at a distance from each other, and the process can further include guiding the fibrous material web through the plurality of displacement dewatering units. The. plurality of dewatering units arranged at a distance from each other may be sequentially arranged in a web travel direction. The process can also include adjusting-the pressures in the plurality of dewatering units.

According to another feature of the present invention, the process may include adjusting a pressure level of at least one of the plurality of gas pressure pulses. The process can also include separately adjusting pressure levels of the plurality of gas pressure pulses.

In accordance with still another feature of the invention, the process can further include guiding the fibrous material web through the dewatering zone along with a membrane, and directing the plurality of gas pulses onto the surface of the fibrous material web through the membrane.

According to a further feature of the instant invention, the process can further include guiding the fibrous material web through the dewatering zone along with at least one of a wire and felt belt, which is arranged on a side of the fibrous material web opposite the surface onto which the plurality of gas pulses are directed.

Inside the dewatering zone, the fibrous material web may be guided through at least one displacement dewatering unit, and the process may further include changing a gas pressure pulse in the at least one displacement dewatering unit over time. The gas pressure pulse in the at least one displacement dewatering unit can change at a certain frequency.

The present invention is directed to an apparatus for dewatering a fibrous material web in a dewatering zone. The apparatus includes a device for forming a plurality of gas pressure pulses which are arranged one after the other within the dewatering zone. The plurality of gas pressure pulses are directed onto a surface of the fibrous material web. The fibrous material web can include one of a paper and a cardboard web.

According to a feature of the instant invention, the device for forming the plurality of gas pressure pulses may include a plurality of displacement dewatering units arranged at a distance from one another within the dewatering zone. The to plurality of displacement dewatering units can be arranged one after the other in a web travel direction. Further, pressures inside the plurality of displacement dewatering units may be adjustable.

In accordance with another feature of the invention, a level of pressure of at least one of the plurality of gas pressure pulses can be adjustable. Pressures of the plurality of gas pressure pulses may be adjusted separately from one another.

A membrane can be arranged to be guided through the dewatering zone with the fibrous material web. The plurality of gas pressure pulses can be directed onto the surface of the fibrous material web through the membrane.

Moreover, at least one of a wire and a felt belt can be arranged to be guided through the dewatering zone with the fibrous material web. The at least one wire and felt belt may be arranged on a side of the fibrous material web opposite the surface onto which the plurality of gas pressure pulses are directed.

The device for forming a plurality of gas pressure pulses can include at least one displacement dewatering unit having gas pressure pulses which are changeable over time. The gas pressure pulses can be changeable at a certain frequency.

The present invention is directed to an apparatus for dewatering a web in a dewatering zone. The apparatus includes a plurality of dewatering devices successively arranged in a web travel direction, where adjacently positioned dewatering devices are spaced from each other, and each dewatering device is arranged to direct a gas pressure onto a surface of the web. In this manner, relative to the web, a plurality of pulses are directed onto the surface of the web.

In accordance with the features of the invention, the gas pressure in each dewatering device may be a constant pressure.

The gas pressure in at least one of the dewatering devices can be adjustable independently of the pressures in the other dewatering devices. Further, the gas pressure in the at least one dewatering device can include gas pressure pulses which are adjustable over time. The gas pressure pulses may be adjustable at a certain frequency.

Moreover, the gas pressures in the dewatering devices can be adjustable independently of each other. The gas pressure in each of the plurality of dewatering devices may include gas pressure pulses which are adjustable over time. The gas pressure pulses can be adjustable at a certain frequency.

One of a wire and a felt belt may be arranged on a side of the web opposite the surface onto which the plurality of gas pulses are directed. A membrane may be arranged adjacent the web and opposite the one of the wire and felt belt, such that the plurality of gas pressure pulses are directed through the membrane.

The present invention is directed to a process for dewatering a web in a dewatering zone that includes an apparatus having a plurality of dewatering devices successively arranged in a web travel direction, such that adjacently positioned dewatering devices are spaced from each other. The process includes guiding the web through the dewatering zone, and directing a gas pressure from each of the plurality of dewatering devices onto a surface of the web. In this way, relative to the web, a plurality of pulses are directed onto the surface of the web.

In accordance with the features of the invention, the gas pressure in each dewatering device may be a constant pressure.

The process can include adjusting the gas pressure in at least one of the dewatering devices independently of the pressures in the other dewatering devices. The gas pressure in the at least one dewatering device may include gas pressure pulses which are adjusted over time. The gas pressure pulses can be adjusted at a certain frequency.

Moreover, the process can include adjusting the gas pressures in the dewatering devices independently of each other. Further, the gas pressure in each of the plurality of dewatering devices can include gas pressure pulses which is adjusted over time. The gas pressure pulses may be adjusted at a certain frequency.

The process can also include guiding the web through the dewatering zone with one of a wire and a felt belt arranged on a side of the web opposite the surface onto which the plurality of gas pulses are directed. The process can also include guiding the web through the dewatering zone with a membrane arranged adjacent the web and opposite the one of the wire and felt belt, such that the plurality of gas pressure pulses are directed through the membrane.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
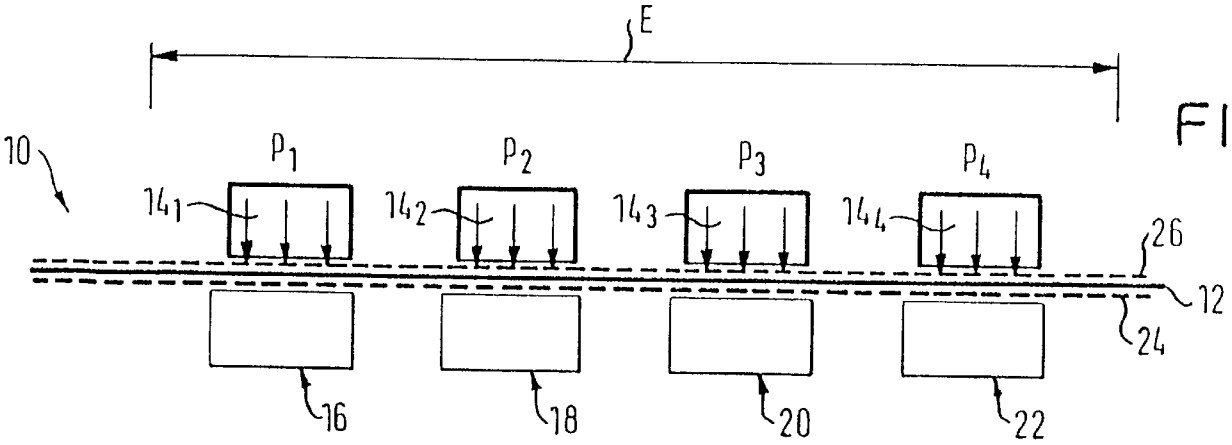
FIG. 1 schematically illustrates a first embodiment of a device for dewatering a fibrous material web in which the fibrous material web is impacted by displacement gas through a membrane.

FIG. 1 schematically illustrates and an exemplary embodiment of a device for dewatering a fibrous material web 12, e.g., a paper or cardboard web.

Dewatering device 10 includes a dewatering zone E in which fibrous material web 12 is at least partially dewatered by being impacted with pressurized displacement gas, e.g., air. In this process, fibrous material web 12 is guided within dewatering zone E through several, e.g., four (as illustrated in the instant embodiment), displacement dewatering units 16 to 22. As a result, fibrous material web 12 is impacted by several gas pressure pulses $\mathbf{14}_1$ to $\mathbf{14}_4$ within dewatering zone E.

The level of pressures $p_1$ to $p_4$ of at least one gas pressure pulse $\mathbf{14}_1$ to $\mathbf{14}_4$ can be adjustable, and, suitably, all pressures $p_1$ to $p_4$ are adjustable. In particular, pressures $p_1$ to $p_4$ of gas pressure pulses $\mathbf{14}_1$, to $\mathbf{14}_4$ can be adjustable independently from one another. The prevailing pressures inside the various displacement dewatering units 16 to 22 are correspondingly adjustable for this purpose.

Fibrous material web 12, which is impacted from one side with displacement gas 14, is guided through dewatering zone E along with at least one wire or felt belt 24, which is arranged on the other side of fibrous web 12, i.e., the side opposite the gas impact.

Further, fibrous material web 12 can be guided through dewatering zone E along with a membrane 26. Thus, fibrous material web 12 can be impacted with displacement gas 14 through membrane 26.

Fibrous material web 12 is impacted from above by displacement gas 14, and membrane 26 is arranged above bonded-web fabric 12, i.e., between bonded-web fabric 12 and gas pressure pulses $\mathbf{14}_1$, to $\mathbf{14}_4$.

Figure 2:
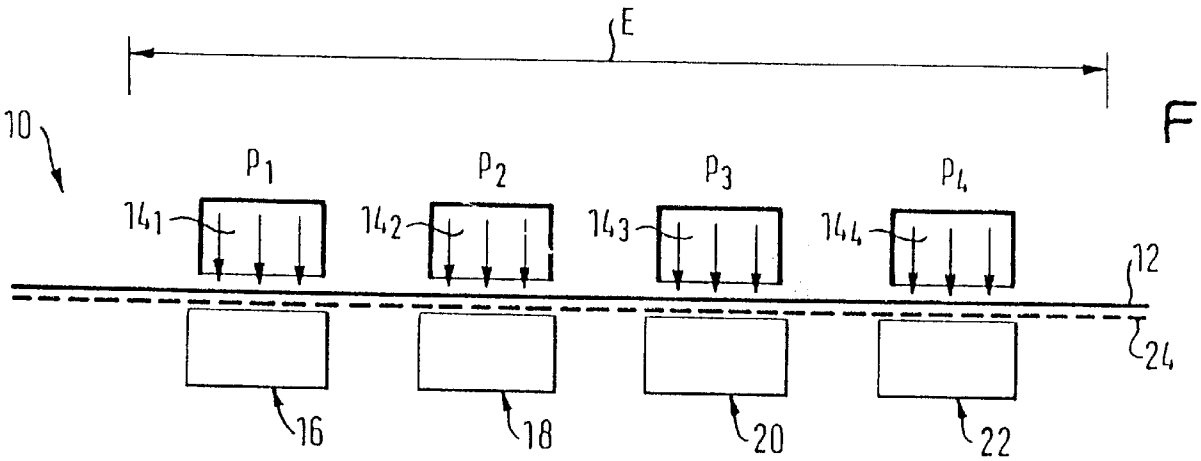
FIG. 2 schematically illustrates a further embodiment of a device for dewatering a material web without a membrane.

An alternative embodiment, schematically illustrated in FIG. 2, differs from the exemplary embodiment of FIG. 1 only in that the membrane has been removed. Corresponding elements have been given the same reference characters.

The dewatering devices of dewatering units 16–22 can be different and, e.g., can run from top to bottom in an alternating fashion. As an example, one dewatering unit can be configured with a blowing device above the web and an adjacent dewatering device can be configured with a suction device below the web. Thus, it is possible to provide, e.g., a connection of several dewatering zones of the type shown in FIGS. 1 and 2 one after the other.

It is noted that the foregoing examples have been provided merely for the purpose of explanation and are in no way to be construed as limiting of the present invention. While the present invention has been described With reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

| | |
|---|---|
| 10 | Dewatering device |
| 12 | Fibrous material web; bonded-web fabric |
| 14 | Displacement gas |
| $14_1$–$14_4$ | Gas pressure pulses |
| 16–22 | Displacement dewatering units |
| 24 | Wire or felt belt |
| 26 | Membrane |
| E | Dewatering zone |
| $p_1$–$p_4$ | Pressures |

What is claimed:

1. A process for dewatering a fibrous material web, comprising:

guiding the fibrous material web through a plurality of displacement dewatering units arranged to form a dewatering zone;

directing, from the plurality of dewatering units, a plurality of gas pressure pulses of a pressurized displacement gas one after the other through the fibrous material web within the dewatering zone; and independently adjusting the pressures in the plurality of dewatering units.

2. The process in accordance with claim 1, wherein the fibrous material web comprises one of a paper and a cardboard web.

3. The process in accordance with claim 1, wherein the plurality of displacement dewatering units are arranged within the dewatering zone at a distance from each other, and the process further comprises guiding the fibrous material web through the plurality of spaced displacement dewatering units.

4. The process in accordance with claim 3, wherein the plurality of dewatering units arranged at a distance from each other are sequentially arranged in a web travel direction.

5. The process in accordance with claim 1, further comprising adjusting a pressure level of at least one of the plurality of gas pressure pulses.

6. The process in accordance with claim 5, further comprising separately adjusting pressure levels of the plurality of gas pressure pulses.

7. The process in accordance with claim 1, further comprising:

guiding the fibrous material web through the dewatering zone along with a membrane; and directing the plurality of gas pulses through the fibrous material web through the membrane.

8. The process in accordance with claim 1, further comprising: guiding the fibrous material web through the dewatering zone along with at least one of a wire and felt belt, which-is arranged on a side of the fibrous material web opposite the surface onto which the plurality of gas pulses are directed.

9. The process in accordance with claim 1, wherein, inside the dewatering zone, the fibrous material web is guided through the plurality of displacement dewatering units, and the process further comprises changing a gas pressure pulse in the plurality of displacement dewatering units over time.

10. The process in accordance with claim 9, wherein the gas pressure pulse in the plurality of displacement dewatering units changes at a certain frequency.

11. An apparatus for dewatering a fibrous material web in a dewatering zone, said apparatus comprising:

a plurality of dewatering units arranged for forming a plurality of gas pressure pulses which are arranged one after the other within the dewatering zone, wherein said plurality of gas pressure pulses are directed through the fibrous material web and wherein pressures inside said plurality displacement dewatering units are independently adjustable.

12. The apparatus in accordance with claim 11, wherein the fibrous material web comprises one of a paper and a cardboard web.

13. The apparatus in accordance with claim 11, wherein said plurality of displacement dewatering units are arranged at a distance from one another within the dewatering zone.

14. The apparatus in accordance with claim 13, herein said plurality of displacement dewatering units are arranged one after the other in a web travel direction.

15. The apparatus in accordance with claim 11, wherein a level of pressure of at least one of said plurality of gas pressure pulses is adjustable.

16. The apparatus in accordance with claim 15, wherein pressures of said plurality of gas pressure pulses are adjusted separately from one another.

17. The apparatus in accordance with claim 11, further comprising a membrane arranged to be guided through the dewatering zone with the fibrous material web, wherein said plurality of gas pressure pulses are directed through the fibrous material web through said membrane.

18. The apparatus in accordance with claim 11, further comprising at least one of a wire and a felt belt arranged to be guided through the dewatering zone with the fibrous material web, wherein said at least one wire and felt belt is arranged on a side of the fibrous material web opposite said surface onto which said plurality of gas pressure pulses are directed.

19. The apparatus in accordance with claim 11, wherein, said at least one displacement dewatering unit having gas pressure pulses which are changeable over time.

20. The apparatus in accordance with claim 19, wherein said gas pressure pulses are changeable at a certain frequency.

21. An apparatus for dewatering a web in a dewatering zone, comprising:

a plurality of dewatering devices successively arranged in a web travel direction, wherein adjacently positioned dewatering devices are spaced from each other;

each dewatering device being arranged to direct a gas pressure through the web, whereby, relative to the web, a plurality of pulses of gas are directed through the web, wherein said gas pressures in said dewatering devices are adjustable independently of each other.

22. The apparatus in accordance with claim 21, wherein said gas pressure in each dewatering device is a constant pressure.

23. The apparatus in accordance with claim 21, wherein said gas pressure in at least one of said dewatering devices is adjustable independently of said pressures in the other dewatering devices.

24. The apparatus in accordance with claim 23, wherein said gas pressure in said at least one dewatering device comprises gas pressure pulses which are adjustable over time.

25. The apparatus in accordance with claim 24, wherein said gas pressure pulses are adjustable at a certain frequency.

26. The apparatus in accordance with claim 21, wherein said gas pressure in each of said plurality of dewatering devices comprises gas pressure pulses which are adjustable overtime.

27. The apparatus in accordance with claim 26, wherein said gas pressure pulses are adjustable at a certain frequency.

28. The apparatus in accordance with claim 21, further comprising one of a wire and a felt belt arranged on a side of the web opposite said surface onto which said plurality of gas pulses are directed.

29. The apparatus in accordance with claim 28, further comprising a membrane arranged adjacent the web and opposite said one of said wire and felt belt, such that said plurality of gas pressure pulses are directed through said membrane.

30. A process for dewatering a web in a dewatering zone that includes an apparatus having a plurality of dewatering devices successively arranged in a web travel direction, such that adjacently positioned dewatering devices are spaced from each other, the process comprising:

guiding the web through the dewatering zone;

directing a gas pressure from each of the plurality of dewatering devices through the web, whereby, relative to the web, a plurality of pulses of gas are directed through the web; and adjusting the gas pressures in the dewatering devices independently of each other.

31. The process in accordance with claim 30, wherein the gas pressure in each dewatering device is a constant pressure.

32. The process in accordance with claim 30, further comprising adjusting the gas pressure in at least one of the dewatering devices independently of the pressures in the other dewatering devices.

33. The process in accordance with claim 32, wherein the gas pressure in the at least one dewatering device comprises gas pressure pulses which are adjusted over time.

34. The process in accordance with claim 33, wherein the gas pressure pulses are adjusted at a certain frequency.

35. The process in accordance with claim 30, wherein the gas pressure in each of the plurality of dewatering devices comprises gas pressure pulses which is adjusted over time.

36. The process in accordance with claim 35, wherein the gas pressure pulses are adjusted at a certain frequency.

37. The process in accordance with claim 30, further comprising guiding the web through the dewatering zone with one of a wire and a felt belt arranged on a side of the web opposite the surface onto which the plurality of gas pulses are directed.

38. The process in accordance with claim 37, further comprising guiding the web through the dewatering zone with a membrane arranged adjacent the web and opposite the one of the wire and felt belt, such that the plurality of gas pressure pulses are directed through the membrane.

* * * * *